US011504288B2

(12) United States Patent
Alston

(10) Patent No.: US 11,504,288 B2
(45) Date of Patent: Nov. 22, 2022

(54) HOSPITAL BED EQUIPMENT HOLDER

(71) Applicant: Eminent Medical Supplies LLC, Charleston, SC (US)

(72) Inventor: Rodney Alston, Charleston, SC (US)

(73) Assignee: EMINENT MEDICAL SUPPLIES LLC, Charleston, SC (US)

( * ) Notice: Subject to any disclaimer, the term of this patent is extended or adjusted under 35 U.S.C. 154(b) by 4 days.

(21) Appl. No.: 16/236,871

(22) Filed: Dec. 31, 2018

(65) Prior Publication Data

US 2020/0206051 A1 Jul. 2, 2020

(51) Int. Cl.
*A61G 7/05* (2006.01)

(52) U.S. Cl.
CPC ..... *A61G 7/0503* (2013.01)

(58) Field of Classification Search
CPC .. A61G 7/0503; A61G 13/105; A47C 20/023; A47C 21/02; A47C 21/026
See application file for complete search history.

(56) References Cited

U.S. PATENT DOCUMENTS 2,979,098 A * 4/1961 Greaves ..... B60R 7/043 224/275
3,717,188 A * 2/1973 Green ..... B60R 7/088 224/42.11
3,967,666 A * 7/1976 Farrar ..... A61G 7/0503 383/7
4,796,790 A * 1/1989 Hamilton ..... A45C 11/00 206/438
5,370,246 A * 12/1994 Traynor ..... A61G 5/10 132/312
5,605,235 A * 2/1997 Johnson ..... F16M 13/00 211/26.1
5,651,152 A * 7/1997 Ritchie ..... A61G 7/05 5/663
5,829,723 A * 11/1998 Brunner ..... A61M 5/1413 248/222.13
6,450,337 B1 * 9/2002 Campagna ..... B25H 3/00 182/129
6,579,008 B2 * 6/2003 Price ..... B65D 33/2541 383/38
6,942,130 B1 * 9/2005 Duva ..... A45F 3/00 135/66
7,398,951 B1 * 7/2008 Sugalski ..... A61G 7/0503 248/214
7,438,194 B2 * 10/2008 Wang ..... A47F 7/146 211/113
7,494,102 B1 * 2/2009 Deal ..... A61G 5/10 220/482
8,152,037 B2 * 4/2012 Sabbag ..... B25H 3/00 224/236
8,844,717 B1 * 9/2014 Ross ..... B25H 3/00 206/373
9,072,637 B1 * 7/2015 Puri ..... A61J 1/16
9,095,222 B2 * 8/2015 Asaf ..... A61G 7/0522
9,185,987 B1 * 11/2015 Nugent ..... A47C 7/622
9,402,477 B2 * 8/2016 Chang ..... A47B 97/00
9,731,414 B2 * 8/2017 Ktytor ..... B25H 3/00
(Continued)

*Primary Examiner* — Robert G Santos
*Assistant Examiner* — Rahib T Zaman
(74) *Attorney, Agent, or Firm* — Dority & Manning, P.A.

(57) ABSTRACT

A latex-free, disposable, transparent carrier includes pockets for holding patient and hospital personnel items to provide more table space and reduce clutter.

19 Claims, 8 Drawing Sheets

(56) References Cited

U.S. PATENT DOCUMENTS

| | | | | |
|---|---|---|---|---|
| 9,844,870 | B2 * | 12/2017 | Reinhart | B25H 3/00 |
| 10,264,892 | B1 * | 4/2019 | Sosa | F16M 13/02 |
| 10,398,525 | B1 * | 9/2019 | West | A61G 1/04 |
| 2005/0087660 | A1 * | 4/2005 | Want | A61M 5/1414 248/304 |
| 2009/0308823 | A1 * | 12/2009 | DiGasbarro | A61G 7/0503 211/85.13 |
| 2011/0016632 | A1 * | 1/2011 | Hopf | A61G 7/0507 5/503.1 |
| 2011/0155795 | A1 * | 6/2011 | James | A61G 7/0503 229/120.02 |
| 2012/0286010 | A1 * | 11/2012 | Mann | B42F 7/10 224/407 |
| 2016/0324708 | A1 * | 11/2016 | Ellis | A61G 7/0507 |
| 2020/0206051 | A1 * | 7/2020 | Alston | A61G 7/0503 |

* cited by examiner

HOSPITAL BED EQUIPMENT HOLDER

FIELD OF THE DISCLOSURE

This disclosure relates to equipment for hospital beds.

BACKGROUND OF THE DISCLOSURE

A hospital bed generally occupies a significant portion of a typical hospital room. The remaining area in the room usually is filled with tables, chairs and medical equipment. Surface and storage areas for books, equipment, and sundry items are at a premium in most hospital rooms.

What is needed in hospitals is a portable implement that can be easily attached to a hospital bed and is accessible by doctors, medical staff, patients and visitors to store or temporarily hold assorted items, but which can be quickly removed from the bed during medical procedures.

SUMMARY OF THE DISCLOSURE

The present disclosure generally provides portable equipment holders for hospital beds to reduce clutter and to eliminate need for additional table space.

According to an embodiment of the disclosure, a latex-free carrier may have two arms or flaps with respective connectors and at least one compartment formed in at least one of the arms. The arms may be attachable to each other by the connectors, wherein the connectors are selected from the group consisting of snaps, hooks, zippers, adhesives, buttons, magnets, hook and loop fasteners, clips, and combinations thereof. The carrier may be substantially clear or transparent, at least at the areas of the compartment, in order for a user to see sundry items within the compartment.

According to another embodiment of the disclosure, a latex-free hospital bed saddlebag may include a first flap having a first distal end and a first proximal end; a second flap having a second distal end and a second proximal end, wherein the first and second flaps are unitarily constructed at the first and second proximal ends and at least one compartment is formed within one of the first and second flaps; and a first connector being arranged at the first distal end and a second connector being arranged at the second distal end, the first and second flaps being attachable to each other by the first and second connectors, wherein the connectors are selected from the group consisting of snaps, adhesives, hooks, zippers, buttons, magnets, hook and loop fasteners, clips, and combinations thereof; wherein the compartment is transparent and includes a slot configured for receiving sundry items. The saddlebag may be made from disposable or recyclable materials such as low-density polyethylene (LDPE).

While the disclosure provides certain specific embodiments, the disclosure is not limited to those embodiments. A person of ordinary skill will appreciate from the description herein that modifications can be made to the described embodiments and therefore that the specification is broader in scope than the described embodiments. All examples are therefore non-limiting.

BRIEF DESCRIPTION OF THE DRAWINGS

A full and enabling disclosure of the present subject matter, including the best mode thereof, directed to one of ordinary skill in the art, is set forth in the specification, which refers to the appended figures, in which.

DETAILED DESCRIPTION

Figure 1:
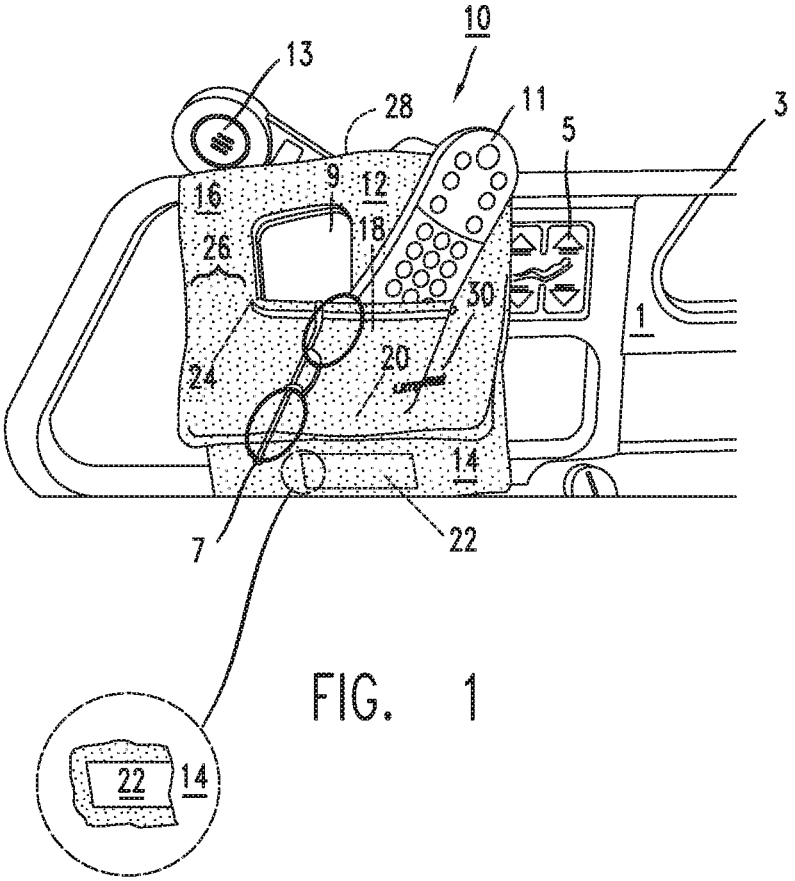
FIG. 1 is front elevational view a holder according to an aspect of the present disclosure, particularly showing a partially cutaway, inset view of an exemplary connector.

Detailed reference will now be made to the drawings in which examples embodying the present subject matter are shown. The detailed description uses numerical and letter designations to refer to features of the drawings.

The drawings and detailed description provide a full and written description of the present subject matter, and of the manner and process of making and using various exemplary embodiments, so as to enable one skilled in the pertinent art to make and use them, as well as the best mode of carrying out the exemplary embodiments. However, the examples set forth in the drawings and detailed descriptions are provided by way of explanation only and are not meant as limitations of the disclosure. The present subject matter thus includes any modifications and variations of the following examples as come within the scope of the appended claims and their equivalents.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Wherever the phrase "for example," "such as," "including" and the like are used herein, the phrase "and without limitation" is understood to follow unless explicitly stated otherwise. Similarly, "an example," "exemplary," and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly, "comprises," "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present disclosure to overcome or ameliorate at least one of the disadvantages of the prior art, or to provide a useful alternative.

DETAILED DESCRIPTION OF THE DRAWINGS

Further embodiments of the present disclosure can be described by reference to the accompanying drawings.

With reference to FIG. 1, a first bag, holder or saddlebag-type carrier is designated in general by the reference number 10. The holder 10 may include two arms or flaps 12, 14, a joint or shoulder 16, and one or more pockets, openings or compartments 18. The flaps 12, 14 may be connectable to each other using devices or connectors 20, 22 such as snaps, hooks, adhesives such as tacky coatings or tape, magnets, hook and loop fasteners, and the like. In this example, the connectors 20, 22 are magnets sewn or fused into respective flaps 12, 14, as most clearly shown in a partially cutaway inset. Thus, when the shoulder 16 is placed over an arm or rail 3 of a hospital bed 1, the magnetic connectors 20, 22 are attracted or drawn to each other to secure the holder 10 over the rail 3 but arranged with sufficient space between the flaps 12, 14 to adjust the holder 10 along the rail 3 where desired so that bed controls 5, for instance, are easily accessible. As noted above, in addition to magnets, or in the alternative, the connectors 20, 22 may be by hook and loop fasteners such as Velcro® brand material or other attachment devices and are not limited to the example shown.

FIG. 1 also shows that at least one of the flaps 12, 14 may include the compartment 18. Here, the compartment 18 includes a slit, pocket, or slot 24 formed in flap 12. The exemplary slot 24 is about two thirds of a width of the flap 12 such that the slot 24 terminates and leaves a perimeter or gap 26, perhaps on both sides of the holder 10. This provides structural integrity and also can prevent items from sliding down into the compartment 18. For instance, a patient (not shown) can place glasses 7, a phone 9, a controller 11, and other items in or through the slot 24 to be held in the compartment 18 and/or partially out of the compartment 18 for easy access. Still further, another slot 28 may be formed on or within the flap 14 on the opposite side to accommodate personal items or equipment 13 carried by visitors or medical personnel attending to the patient.

Notably, many patients, as well as visitors and staff, may be allergic to latex material. Even those with minor latex allergies, which can result in rashes and hay fever symptoms when exposed to latex. Such people must minimize their exposure, so they do not risk becoming more sensitive to latex. Persons at elevated risk include those who use natural rubber latex gloves everyday such as physicians, nurses, dentists, and associated staff and assistants.

While uncommon, some latex allergic individuals can suffer a potentially life-threatening allergic reaction called anaphylactic shock when they encounter natural rubber latex. Accordingly, the holder 10 and its components may be made from non-latex or latex-free material as indicated by the prominent safety designation 30. Latex-free material 30 such as plastic also makes cleaning the holder 10 easier. Additionally, the holder 10 is made from material that can be recycled or destroyed if the holder 10 becomes damaged or otherwise becomes unusable or unserviceable due to exposure to bodily fluids that may carry communicable diseases, bacteria or viruses and are best placed in human waste receptacles for sanitary disposal.

Figure 2:
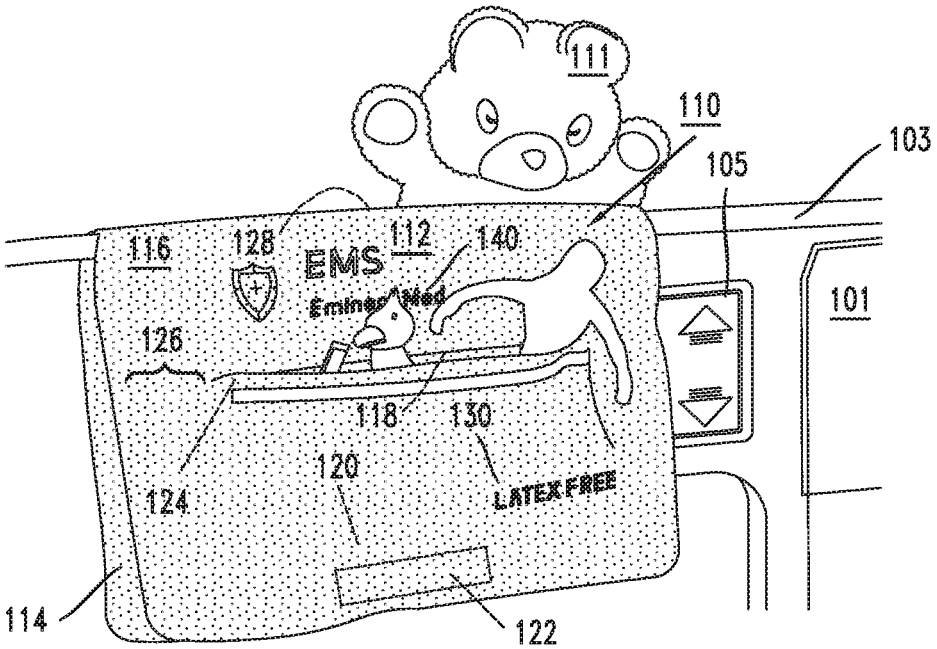
FIG. 2 is a front elevational view of another holder according to the present disclosure.

Turning now to FIG. 2, another valet bag is designated in general by the reference number 110. The valet bag 110 may include two body flaps 112, 114, a shoulder 116, and one or more pockets, openings or compartments 118. The flaps 112, 114 may be connectable to each other using devices or connectors 120, 122 such as snaps, hooks, zippers, adhesives such as tacky coatings or tape, buttons, magnets, hook and loop fasteners and the like. In this example, the connectors 120, 122 are magnets sewn or fused into respective flaps 112, 114, but they may be by hook and loop fasteners such as Velcro® brand material or other attachment devices and are not limited to the example shown. Thus, when the shoulder 116 is placed over an arm or rail 103 of a hospital bed 101, the connectors 120, 122 are attracted, drawn, or temporarily attached to each other to secure the holder 110 over the rail 103 and arranged with sufficient space between the flaps 112, 114 to adjust the holder 110 along the rail 103 where desired so that bed controls 105, for instance, are easily accessible.

FIG. 2 also shows that at least one of the flaps 112, 114 may include the compartment 118. Here, the compartment 118 is a slit, pocket, or slot 124 formed in flap 112. The exemplary slot 124 is about two thirds of a width of the flap 112 such that the slot 124 terminates and leaves a perimeter or gap 126, perhaps on both sides of the holder 110 for structural integrity. A child or minor patient (not shown) can place comfort items such as toys 111 or other items in the slot 124. Still further, another slot 128 may be formed on or within the flap 114 on the opposite side to accommodate equipment carried by visitors or medical personnel attending to the patient.

Notably, many patients, as well as visitors and staff, may be allergic to latex material. Even those with minor latex allergies—which can result in rashes and hay fever symptoms when exposed to latex—should minimize their exposure so they do not risk becoming more sensitive to latex. Persons at considerable risk include those who use natural rubber latex gloves everyday such as physicians, nurses, dentists, and associated staff and assistants. Also, children with medical conditions such as spina bifida with frequent exposure to natural rubber latex products are also commonly latex allergic.

While uncommon, some latex allergic individuals can suffer a potentially life-threatening allergic reaction called anaphylactic shock when they encounter natural rubber latex. Accordingly, the holder 110 and its components may be made from non-latex or latex-free material as indicated by the prominent designation 130, shown here in proximity to Applicant's mark 140. Latex-free material 130 such as plastic also makes cleaning the holder 110 easier. Additionally, the holder 110 is made from material that can be recycled if the holder 110 becomes damaged or otherwise becomes unusable or unserviceable due to exposure to some bodily fluids that may carry communicable diseases or viruses and are best placed in human waste receptacles for sanitary disposal.

Figure 3:
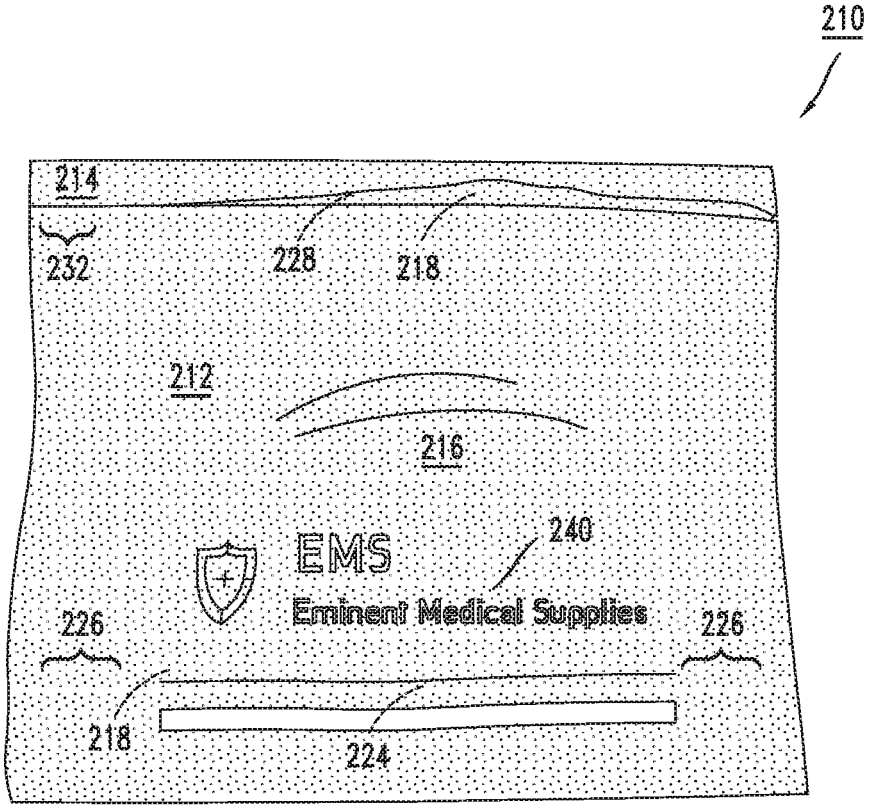
FIG. 3 is an elevational view of a carrier according to another aspect of the disclosure.

In FIG. 3, another carrier is designated in general by the reference number 210. The carrier 210 may include two body flaps or arms 212, 214, a shoulder 216, and one or more pockets, openings or compartments 218 having respective slits 224, 228. The flaps 212, 214 may be connectable to each other using devices or connectors (see 120, 122 above, for example) such as snaps, adhesives such as tacky coatings or tape, hooks, magnets, hook and loop fasteners and the like to secure the carrier 210 over a hospital bed rail (see rail 103 above, for example) but arranged with sufficient space between the flaps 212, 214 to adjust the carrier 210 along the rail where desired so that bed controls on the rail, for instance, are easily accessible.

Figure 4:
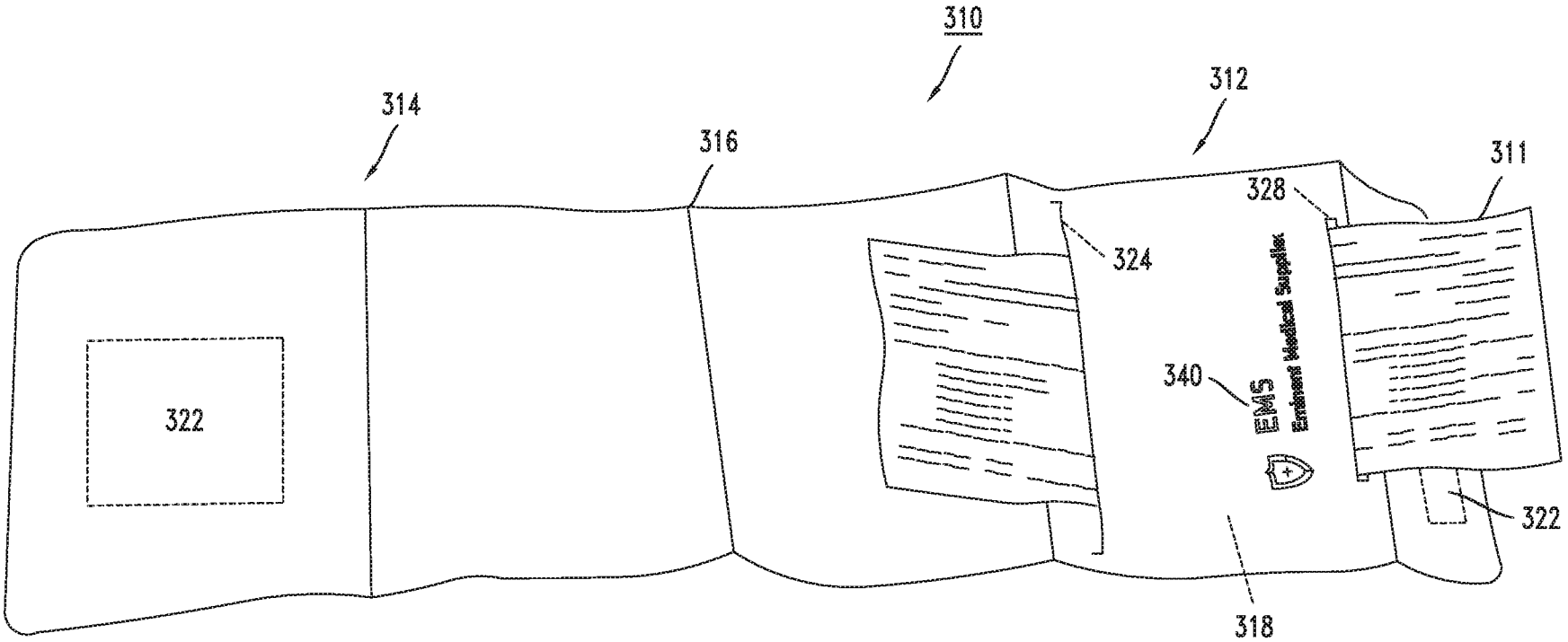
FIG. 4 is a plan view of another carrier according to another aspect of the disclosure.

Another embodiment shown in FIG. 4 designated in general by the reference number 310 includes two flaps 312, 314, a shoulder 316, and one or more pockets, openings or compartments 318 having respective slits 324, 328. The flaps 312, 314 may be connectable to each other using devices or connectors 322 such as snaps, adhesives such as tacky coatings or tape, hooks, magnets, hook and loop fasteners and the like to secure the carrier 310 over a hospital bed rail (see rail 103 above, for example) but arranged with sufficient space between the flaps 312, 314 to adjust the carrier 310 along the rail where desired so that bed controls on the rail, for instance, are easily accessible. Here, adhesive connectors 322 may be attached to one or both flaps 312, 314 and activated, for instance, by peeling away a protective covering like wax paper from the adhesive connectors 322.

As further shown in the example of FIG. 4, an overall length of the carrier 310 is approximately thirty-one inches (31 in.) and its width is approximately eight and one quarter inches (8¼ in.), although the sizes may be adjusted. Also shown in this exemplary embodiment, a treatment notice or other paperwork 311 can be placed in slits 324, 328 in ready view of and accessible to medical personnel attending to the patient.

Figure 5:
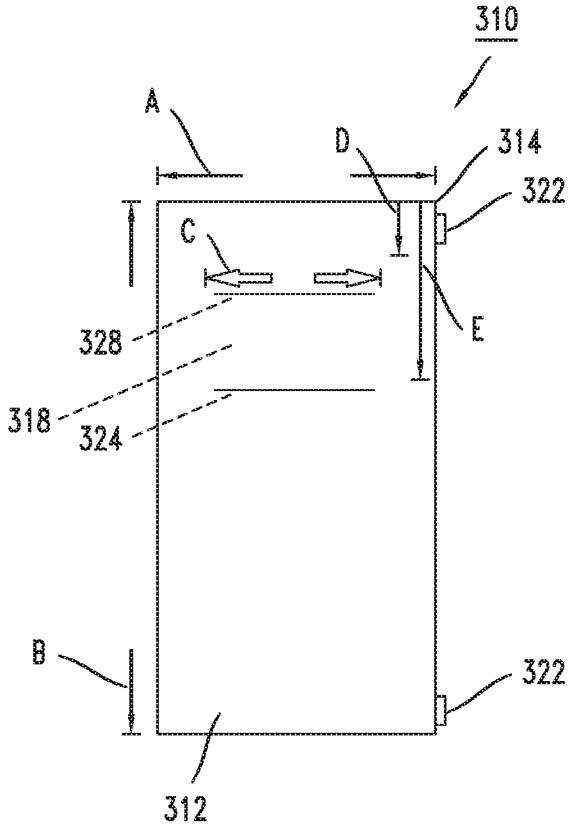
FIG. 5 is another plan view of the carrier as in FIG. 4.

Turning now to FIG. 5, the compartment 318 and its respective slits 324, 328 are most clearly shown. Here, the overall width of the carrier 310 is indicated by measurement A and the overall length is indicated by measurement B. By way of example but not of limitation, the width A may be about six inches (6 in.) to about ten inches (10 in.), more particularly about seven inches (7 in.). Likewise, the exemplary length B of the carrier 310 may be about ten inches (10 in.) to about twenty inches (20 in.), more particularly about fifteen inches (15 in.). Still further, the exemplary slots 324, 328 may be about two inches (2 in.) to about five inches (5 in.), more particularly about fifteen inches (3 in.) in this example. Here, adhesive connectors 322 may be attached to one or both ends 312, 314. In this example, the connectors 322 may be about five square inches (5 in.$^2$).

Figure 6:
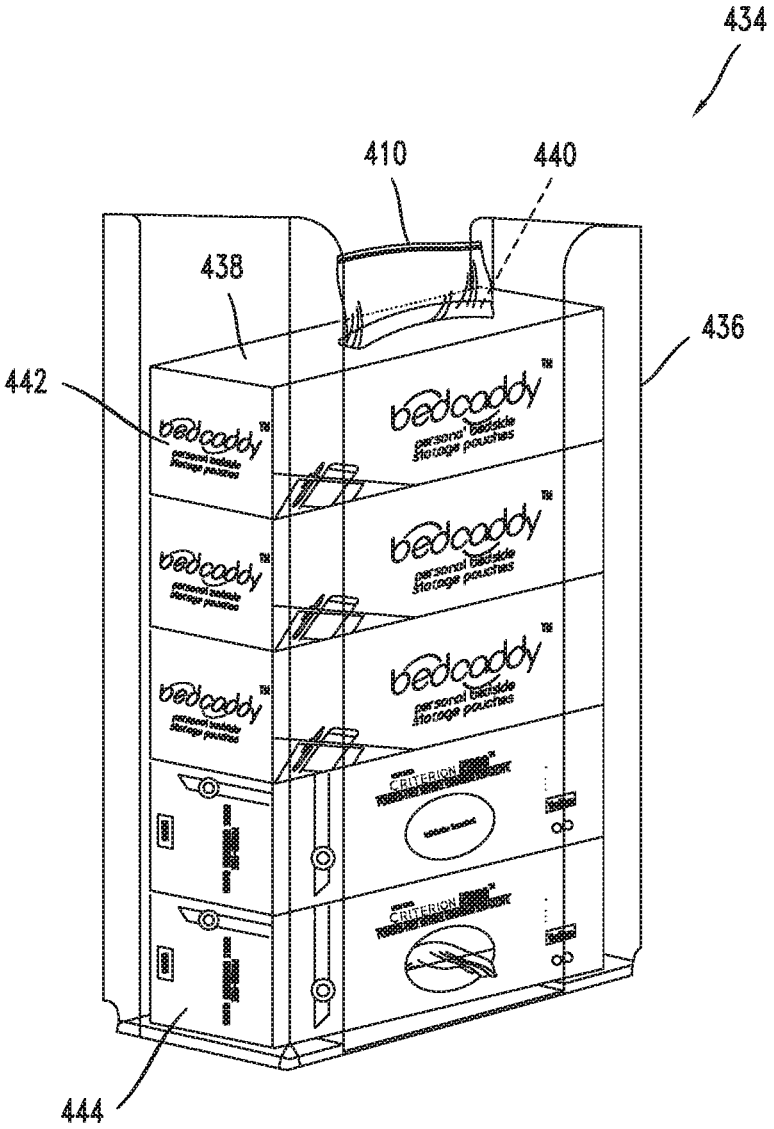
FIG. 6 is a perspective view of a system for providing carriers according to another aspect of the disclosure.

With reference to FIG. 6, a system for dispensing disposable saddlebag carriers 410 is designated in general by the element number 434. The dispensing system 434 includes a plastic holder 436 that may be clear and attachable to a wall in a hospital room. As shown, the carriers 410 may be packaged in boxes 438 having a dispensing aperture 440. Here, the Applicant's BED CADDY™ marks the boxes 438, and each box 438 is substantially the same size as standard boxes 444 used for dispensing examination gloves; therefore, the boxes 438 may be stocked in the same holder 436 as the boxes 444 and do not require an additional storage area.

Another embodiment shown in FIG. 4 designated in general by the reference number 310 includes two flaps 312, 314, a shoulder 316, and one or more pockets, openings or compartments 318 having respective slits 324, 328. The flaps 312, 314 may be connectable to each other using devices or connectors 322 such as snaps, adhesives such as tacky coatings or tape, hooks, magnets, hook and loop fasteners and the like to secure the carrier 310 over a hospital bed rail (see rail 103 above, for example) but arranged with sufficient space between the flaps 312, 314 to adjust the carrier 310 along the rail where desired so that bed controls on the rail, for instance, are easily accessible. Here, adhesive connectors 322 may be attached to one or both flaps 312, 314 and activated, for instance, by peeling away a protective covering like wax paper from the adhesive connectors 322.

Figure 7:
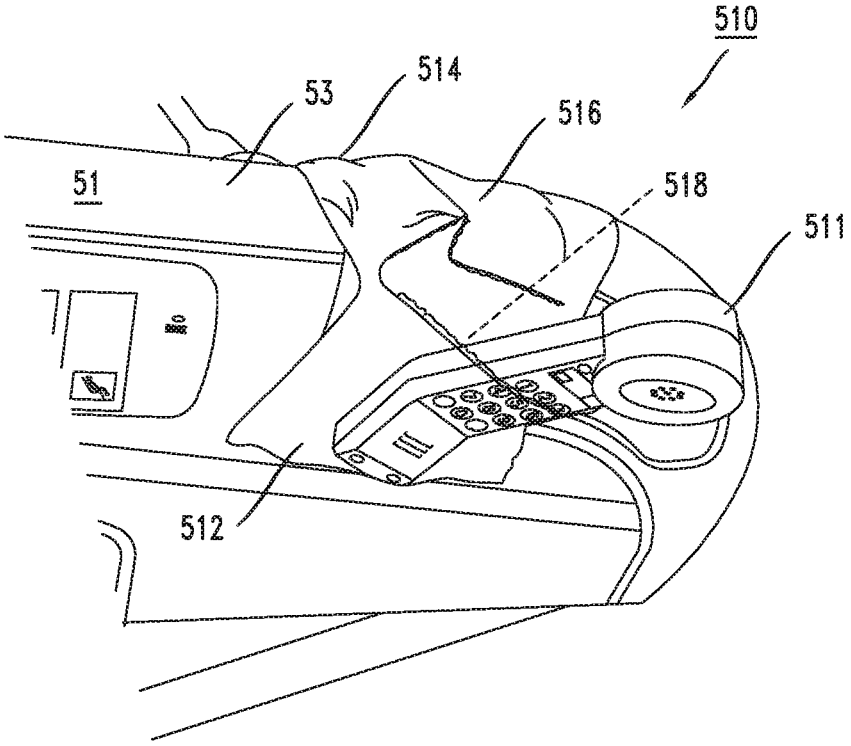
FIG. 7 is a perspective view of another carrier according to another aspect of the disclosure.
Figure 8:
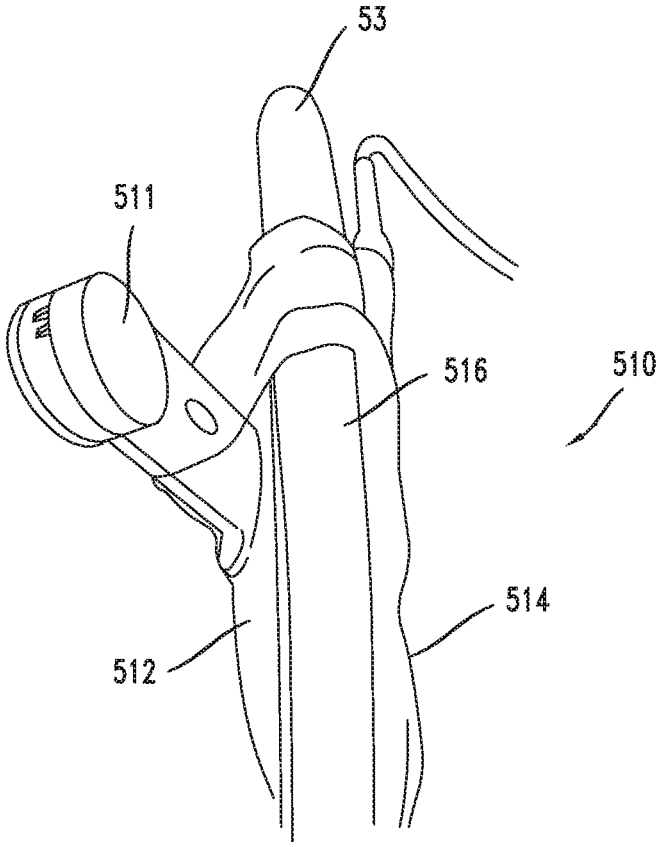
FIG. 8 is a perspective view of another carrier according to another aspect of the disclosure.

In FIGS. 7 and 8 a clear, preferably latex-free, carrier 510 may be made of recyclable or disposable low-density polyethylene (LDPE). The exemplary carrier 510 includes two flaps 512, 514, a shoulder 516, and one or more pockets, openings or compartments 518. The flaps 312, 314 may be connectable to each other using devices or connectors such as snaps, adhesives such as tacky coatings or tape, hooks, magnets, hook and loop fasteners and the like to secure the carrier 510 over a hospital bed rail 53 of a bed 51. Here, because the carrier 510 is clear, call buttons on a hospital phone 511 can be seen and pushed in an emergency or by weak patients without having to take the phone 511 out of the compartment 518.

Although the examples shown in the foregoing figures depict two slots or pockets, the disclosure is not limited to only one or two slots. Additional slots or pockets, with or without covers or pocket flaps, may be provided.

EXEMPLARY EMBODIMENTS

By way of example and not of limitation, some potential claims in a utility patent application that may claim benefit of the present application could include but are not limited to:

Embodiment 1

A carrier comprising two arms having respective connectors and at least one compartment in at least one of the arms, the arms being attachable to each other by the connectors, wherein the connectors are selected from the group consisting of snaps, adhesives, hooks, zippers, buttons, magnets, hook and loop fasteners, clips, and combinations thereof.

Embodiment 2

The device of embodiment 1, wherein the connectors are magnets, the magnets being heat welded within the arms.

Embodiment 3

The device of any one of embodiments 1-2, wherein the compartment has an opening slot configured for receiving sundry items.

Embodiment 4

The device of any one of embodiments 1-3, wherein the carrier is latex-free.

Embodiment 5

A latex-free hospital bed saddlebag, comprising a first flap having a first distal end and a first proximal end; a second flap having a second distal end and a second proximal end, wherein the first and second flaps are unitarily constructed at the first and second proximal ends and at least one compartment is formed within one of the first and second flaps;

and a first connector being arranged at the first distal end and a second connector being arranged at the second distal end, the first and second flaps being attachable to each other by the first and second connectors, wherein the connectors are selected from the group consisting of snaps, adhesives, hooks, zippers, buttons, magnets, hook and loop fasteners, clips, and combinations thereof; wherein the compartment is transparent and includes a slot configured for receiving sundry items.

Embodiment 6

The device of embodiment 5, wherein the carrier is constructed of disposable plastic.

As previously stated, detailed embodiments are disclosed herein; however, it is to be understood that the disclosed embodiments are merely examples that may be embodied in various forms. It will be appreciated that many modifications and other variations stand within the intended scope of this disclosure as claimed below. Furthermore, the foregoing description of various embodiments does not necessarily imply exclusion. For example, "some" embodiments may include all or part of "other" and "further" embodiments within the scope of this disclosure. In addition, "a" does not mean "one and only one;" "a" can mean "one and more than one."

That which is claimed is:

1. A hospital bed carrier, comprising:

a first flap having a first distal end and a first proximal end, wherein the first flap forms a compartment forming a slot, wherein the slot leaves a gap from at least one side along a width of the hospital bed carrier;

a second flap having a second distal end and a second proximal end, wherein the first and second flaps are unitarily constructed at the first and second proximal ends, and wherein the unitarily constructed first flap and second flap form a compartment forming a first slot and a second slot, wherein a gap is formed from the slot to at least one side along a width of the unitary structure, wherein the compartment extends from the first slot formed proximal to the first end of the first flap to the second slot formed at the first flap distal to the first end; and a first connector being arranged at the first distal end and a second connector being arranged at the second distal end, the first and second flaps being attachable to each other by the first and second connectors.

2. The hospital bed carrier as in claim 1, wherein the first and second connectors comprise snaps, adhesives, hooks, zippers, buttons, magnets, hook and loop fasteners, clips, or combinations thereof.

3. The hospital bed carrier as in claim 1, wherein the compartment has a slot configured for receiving sundry items.

4. The hospital bed carrier as in claim 1, wherein the carrier is constructed of latex-free material.

5. The hospital bed carrier as in claim 1, wherein the carrier is constructed of transparent material.

6. A holder for a hospital fixture, comprising:

a unitary structure comprising a first flap at a first end and a second flap at a second end distal along a length of the unitary structure, the unitary structure comprising a shoulder positioned along the length between the first flap and the second flap, wherein the unitary structure comprises a compartment forming a first slot and a second slot, wherein a gap is formed from one or both of the first slot or second slot to at least one side along a width of the unitary structure, wherein the compartment extends from the first slot formed proximal to the first end of the first flap to the second slot formed at the first flap distal to the first end.

7. The holder of claim 6, wherein the slot extends approximately two-thirds of the width of the unitary structure.

8. The holder of claim 6, wherein the compartment comprises a first compartment formed at the first flap and a second compartment formed at the second flap.

9. The holder of claim 8, wherein the first compartment is proximal to the first end, and wherein the second compartment is proximal to the second end.

10. The holder of claim 6, wherein the first slot is smaller than the second slot along the width of the unitary structure.

11. The holder of claim 6, wherein the first slot is between approximately 2 inches and approximately 5 inches.

12. The holder of claim 6, wherein the width of the unitary structure is between approximately 6 inches and approximately 10 inches.

13. The holder of claim 6, wherein the length of the unitary structure is between approximately 10 inches and approximately 20 inches.

14. The holder of claim 6, the holder comprising:

a first connector being arranged at the first distal end; and a second connector being arranged at the second distal end, the first and second flaps being attachable to each other by the first and second connectors.

15. The holder of claim 14, wherein the connectors comprise one or more of snaps, adhesives, hooks, zippers, buttons, magnets, hook and loop fasteners, clips, or combinations thereof.

16. The holder of claim 6, wherein the unitary structure comprises a low-density polyethylene material.

17. A dispensing system, the dispensing system comprising:

the carrier of claim 1; and a packaging configured to contain a plurality of carriers, the packaging comprising an aperture configured to dispense the carrier.

18. The dispensing system of claim 17, the dispensing system comprising:

a holder configured to contain and stack a plurality of the packaging.

19. The dispensing system of claim 18, wherein the holder is attachable to a wall.

* * * * *